US006912830B2

(12) United States Patent
Limousin

(10) Patent No.: US 6,912,830 B2
(45) Date of Patent: Jul. 5, 2005

(54) FILM DELIVERY METHOD FOR SHRINK WRAP PACKAGING

(75) Inventor: Jean-Louis Limousin, Louisville, KY (US)

(73) Assignees: Lantech Management Corp., Louisville, KY (US); Lantech Holding Corp., Louisville, KY (US)

( * ) Notice: Subject to any disclaimer, the term of this patent is extended or adjusted under 35 U.S.C. 154(b) by 0 days.

(21) Appl. No.: 10/860,465

(22) Filed: Jun. 3, 2004

(65) Prior Publication Data

US 2004/0216428 A1 Nov. 4, 2004

Related U.S. Application Data

(62) Division of application No. 10/286,523, filed on Nov. 1, 2002, now Pat. No. 6,817,163.

(51) Int. Cl.[7] ..... B65B 9/06
(52) U.S. Cl. ..... 53/459
(58) Field of Search ..... 53/450, 455, 459, 53/64, 550, 568, 399.4; 493/476, 478

(56) References Cited

U.S. PATENT DOCUMENTS

| | | | |
|---|---|---|---|
| 3,494,096 | A | 2/1970 | Suzuki |
| 3,583,888 | A | 6/1971 | Shanklin |
| 3,595,456 | A | 7/1971 | Rosenthal |
| 3,732,789 | A | 5/1973 | Hartlieb |
| 3,800,499 | A | 4/1974 | Feldman |
| 4,035,983 | A | 7/1977 | Shanklin et al. |
| RE30,010 | E | 5/1979 | Shanklin |
| 4,185,443 | A | 1/1980 | Budzyn |
| 4,219,988 | A | 9/1980 | Shanklin et al. |
| 4,325,519 | A | 4/1982 | McLean |
| 4,339,093 | A | 7/1982 | Shanklin et al. |
| 4,519,185 | A | 5/1985 | Horn et al. |
| 4,649,693 | A | 3/1987 | Yeager |
| 4,936,079 | A | 6/1990 | Skalsky et al. |
| 5,134,835 | A | 8/1992 | Walkiewicz, Jr. et al. |
| 5,152,738 | A | 10/1992 | Zehender |
| 5,165,221 | A | 11/1992 | Udelson et al. |
| 5,235,792 | A | 8/1993 | Hanagata |
| 5,381,640 | A | 1/1995 | Chiu |
| 5,603,202 | A | 2/1997 | Hanagata |
| 5,956,931 | A | 9/1999 | Stork |
| 6,044,615 | A | 4/2000 | Fukuda |

FOREIGN PATENT DOCUMENTS

| | | |
|---|---|---|
| DE | 19515719 | 11/1996 |
| JP | 1153408 | 6/1989 |

*Primary Examiner*—John Sipos
(74) *Attorney, Agent, or Firm*—Wood, Herron & Evans, LLP

(57) ABSTRACT

An automatic high-speed wrapping system for wrapping packages in heat sealable thermoplastic film includes a film delivery unit wherein the film is dispensed and wrapped around the packages at a high rate of speed as the packages travel through the system. The packages travel continuously in a straight line through the system and are delivered at the input end of the system by a feed conveyor into a wrapping station where the packages are surrounded by the film, thence to the side sealing mechanism which forms a seal while severing the salvage from the packages, then into an end sealing mechanism where both ends of the packages are sealed and the film web connecting succeeding packages is severed. The film is delivered to the wrapping station in two plies and subsequently inverted for wrapping around the products. The positions of the wrapping station and film delivery units are adjustable to efficiently accommodate a variety of product heights while providing proper film delivery geometry.

20 Claims, 5 Drawing Sheets

FILM DELIVERY METHOD FOR SHRINK WRAP PACKAGING

This is a divisional of U.S. patent application Ser. No. 10/286,523, filed Nov. 1, 2002 and issued as U.S. Pat. No. 6,817,163 on Nov. 16, 2004 and hereby incorporated by reference in its entirety.

BACKGROUND OF THE INVENTION

This invention relates generally to the art of film wrapping systems for use in wrapping objects with shrink wrap film, such as polyurethane wrapping film, and more particularly to improvements directed to dispensing such film from a film roll.

A wide variety of systems are known for wrapping packages in thermoplastic film. Some of these machines are known as L-sealers because they form "trim seals" utilizing a web of center folded film. More recent machines have utilized a continuous longitudinal sealer and a cross sealer which moves at approximately the velocity of the packages as they travel through the machine so that it is not necessary to stop the packages while performing the end sealing operation. Such prior art machines have generally been of three types. One type had a continuous side sealer and a complex series of multiple flighted end sealing jaws which were spaced for a particular product. This type required substantial set-up time for change in length of product to be wrapped. A second machine of this type, while making packages similar to those produced on an L-sealer worked by drawing film off a roll under tension, folding it around the product, drawing it past a hot knife side sealing mechanism and then formed the end seal with a moving end sealer.

A third type of machine had an overlapped longitudinal seal on the top or bottom of the wrapped packages. Since the overlap not only ran along the bottom of the packages but also ran halfway up both ends, the packages lacked the neat appearance and hence the sales appeal of the trim sealed packages as made on the L-sealers. Since many of the products so wrapped are sold in self-service retail stores, the appearance of the package has an important effect on the sales of the product. An additional disadvantage of the overlapped seal is that the width of the web of film must be precisely correct, requiring an exact width film for each size of product.

Shrink wrap packaging systems of these types process and wrap a variety of different products. Commonly, such products are of differing shapes, sizes and dimensions. For example, shrink wrap packaging systems may process and wrap a single compact disc (CD) package which is very thin or other consumer retail items which have a significantly greater height and larger vertical dimension.

One problem associated with most known shrink wrap packaging system is the difficulty to efficiently process and wrap a wide variety of packages and products, especially those having distinctly different dimensions and heights. For example, most known shrink wrap packaging systems utilize film which is provided on a roll in two plies with each ply being joined together by a longitudinal fold line. The two-ply film is dispensed from the supply roll typically in a direction generally perpendicular to the feed direction of the products to be wrapped. As the film is dispensed and delivered to a wrapping station of the shrink wrap packaging system, it is commonly inverted and reoriented to provide an opening for convenient access and entry of the products between the dual plies of the film. The film is reoriented by an upper and a lower film inverting rod or plow system. The upper and lower film inverting rods are positioned above and below, respectively, the feed conveyor which is advancing the products to be wrapped. Examples of such an arrangement are shown in U.S. Pat. Nos. 3,583,888; 3,583,889; 4,035,983; and 4,219,988, each of which are incorporated by reference herein.

The film inverter rods disclosed in the above-identified patents are each fixed relative to one another so that the spacing between the inverter rods is fixed. Recent advancements in the art of shrink wrap packaging systems have included adjustable film inverter rods to accommodate a variety of differing height products being wrapped. As such, the spacing between the film inverter rods may be adjustable.

However, one problem associated with adjustable film inverter rods is that the delivery of the two-ply film to the film inverter rods is often misaligned providing for poor geometry for the film being delivered to the film inverter rods once the spacing between the inverter rods is changed. Optimally the free edges of the upper and lower plies should be generally aligned with one another downstream from the film inverter rods for proper wrapping of the products and positioning of the side seam on the product. However, when the upper film inverter rod is moved relative to the lower film inverter rod for a different height product, the geometry of the film being delivered and processed at the wrapping station becomes misaligned. As a result, the film will not track properly and will not be in the required tubular configuration at the wrapping station. This requires readjustment and/or refeeding of the film through the various rollers, significant operator involvement and down time of the packaging system. The misalignment of the upper and lower plies of the film results in improperly wrapped products, side seals on the products which are located in a conspicuous or improper location, inefficient use or waste of the film wrapping material and other associated problems.

Therefore, a need exists in the shrink wrap packaging industry for a packaging system which can readily accommodate a wide variety of product configurations and heights without the above-described problems associated with known film delivery systems and wrapping operations.

SUMMARY OF THE INVENTION

These and other objectives have been achieved with this invention, which in one embodiment includes a film delivery unit for a shrink wrap packaging system. The film wrapping system includes a feed conveyor to delivery a series of products to a wrapping station. The wrapping station includes a pair of film inverter rods which are adjustable for spacing from one another to correspond to the height of the product being wrapped. A film delivery unit dispenses a supply of two-ply film in a direction generally perpendicular to the feed direction of the products. The two-ply film is inverted by the inverter rods at the wrapping station where the products are inserted between the plies of the film. The system includes a film inverter rod adjustment mechanism to adjust the spacing between the rods.

The system also includes a film delivery unit adjustment mechanism to adjust a position of the film delivery unit and the film being delivered to the wrapping station as a function of the spacing between the film inverter rods and, consequently, the height of the product being wrapped. In one embodiment of this invention, the film delivery unit adjustment mechanism moves the film delivery unit and the supply of film upstream in the feed direction relative to the film inverter rods for larger height products and downstream for smaller height products. Additionally, the system in another embodiment includes an adjustable roller positioned between the film delivery unit and the wrapping station to deliver the film to the wrapping station at a desired height relative to the position of the film inverter rods.

The shrink wrap packaging system also includes a side seal mechanism and an end seal mechanism each located downstream in the feed direction from the wrapping station to join the first and second plies together and enclose each of the products in individually wrapped packages. A heat shrink tunnel in one embodiment is located downstream from the sealing mechanisms to heat the film and thereby shrink it around the product as is well known in the industry.

As a result of the film delivery unit and associated adjustment mechanism according to this invention, a variety of product configurations and heights can be conveniently and efficiently wrapped while adjusting the spacing between the film inverter rods without fouling the geometry of the film delivery system and thereby avoiding the associated problems and disadvantages of shrink wrap packaging systems in the prior art.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
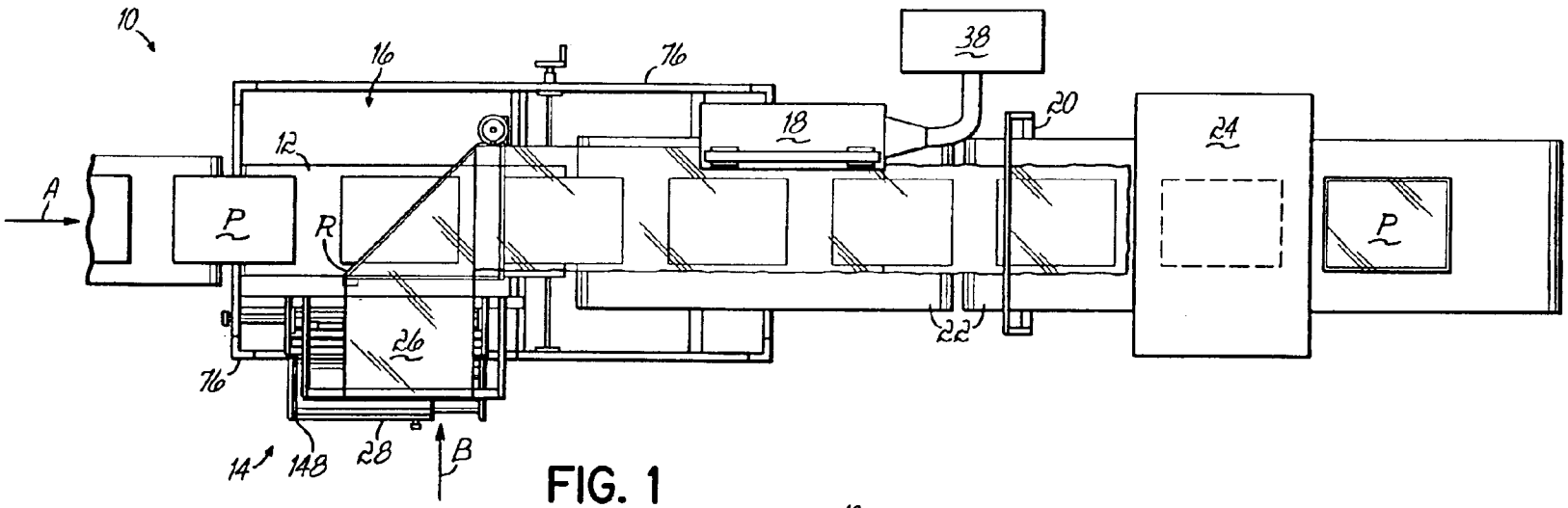
FIG. 1 is a top view of a film wrapping system and associated method according to one embodiment of this invention.

Referring now to FIG. 1, a top view of an exemplary automatic high-speed film packaging system 10 according to one embodiment of this invention is shown. The system 10 generally includes a feed conveyor 12, a film delivery unit 14, a wrapping station 16, a side sealer 18, an end sealer 20, associated downstream conveyor(s) 22 and a heat shrink tunnel 24. Products P to be wrapped in film 26 enter the system 10 via a feed conveyor 12. The conveyor 12 delivers the spaced-apart and generally aligned products P to the wrapping station 16 where a folded film 26 from a film roll 28 in the film delivery unit 14 surrounds each product P. The folded film 26 enveloping each product P is sealed at its free edges 30, 30 by the side sealer 18 to form a tube of film 26 enclosing the spaced products P. The film salvage 32 (FIG. 2) at the sealed edge 34 is severed and removed. The film 26 between the adjacent products P is sealed and severed at the end sealer 20 to produce individual sealed packages of the product P.

The system 10 wraps a product P in a flexible plastic film 26 in which the travel of the product P is essentially continuous through the system 10 in a feed direction indicated by arrow A. The film 26 may be any one of a variety of films well known in the art and is supplied to the system 10 as a folded web at right angles to the feed direction of the product P (shown in FIGS. 1 and 2) through the system. The film 26 is provided to upper and lower inverter rods 36*a*, 36*b* of the wrapping station 16 where the film 26 is redirected and turned inside out to travel in the feed direction with the products P delivered by the feed conveyor 12.

The feed conveyor 12 pushes products P into the wrapping station 16 to cause them to be enclosed by the folded film 26 supplied by film delivery unit 14 on the top, bottom, and one side of the product P with the other side of the product P adjacent to the free edges 30, 30 of the folded film 26 being open initially. The product P thus enclosed in the web of film 26 travels with the film 26 past the side sealing mechanism 18 in FIG. 1 which seals the two free edges 30, 30 of the folded film 26 together to form a continuous tube of film which envelops the succession of products P which are being fed into the system 10 by feed conveyor 12. The side sealer 18 also severs the excess width 32 of film 26 from the tube and this salvage 32 is removed by a salvage accumulator 38, such as a vacuum or other take-up mechanism.

As the product P progresses further through the system 10, the end sealing mechanism 20 seals the trailing edge 40 of each package while simultaneously sealing the leading edge 42 of the succeeding package in the system and it also severs one package from the other while the packages are traveling without stopping through the system 10. The end seal mechanism 20 is so designed that it travels a short distance with the product P at substantially the same velocity while the seal is being made. After the seal has been made, the sealing mechanism 20 releases from the film 26 and returns to its original position to repeat the transverse seal for the next product. The wrapped product may then be conveyed through the shrink tunnel 24 for shrinking of the film around the product. While exemplary embodiments of the side sealer 18, end sealer 20 and shrink tunnel 24 are shown and described herein as part of the system, specific models or embodiments of these components could readily be varied or changed as known by one of ordinary skill in this art without departing from the scope of this invention.

Because the product P being wrapped in the film proceeds through the system 10 at a substantially uniform velocity, the system 10 is capable of operating at film web speeds as high as 120 feet per minute although 60 to 100 feet per minute is a more typical speed. The system 10 is capable of wrapping in excess of one product P per second.

Figure 2:
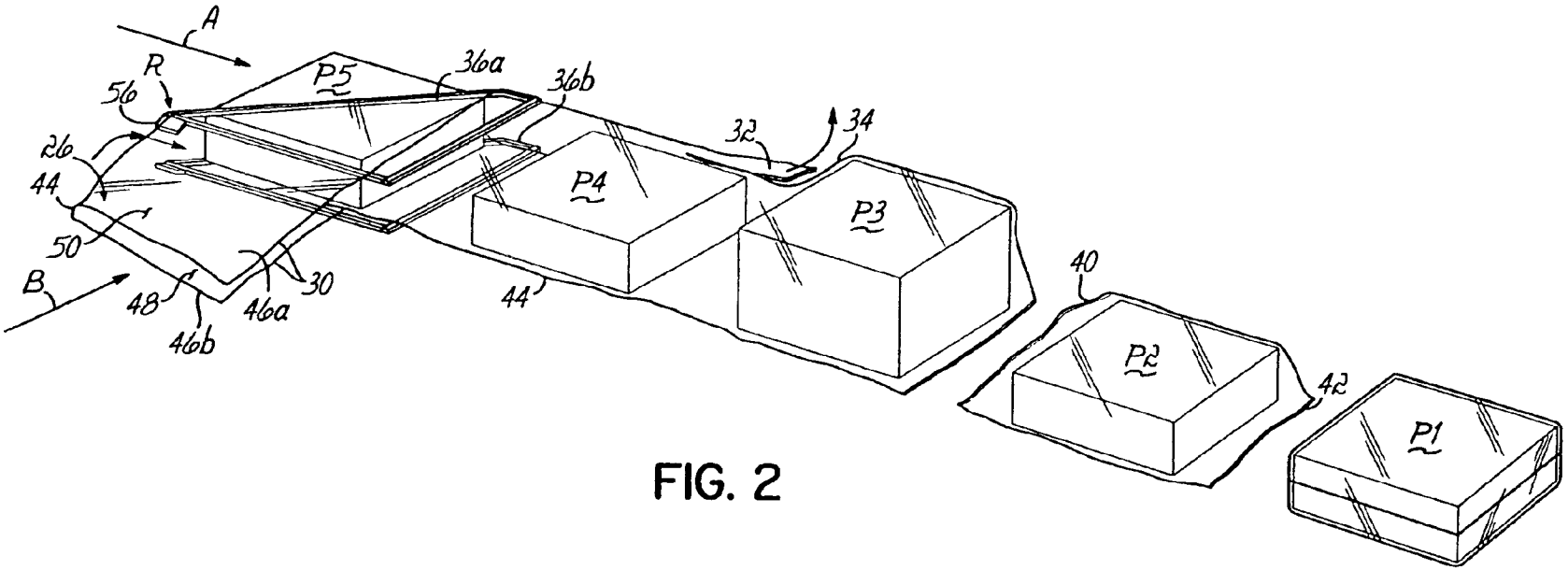
FIG. 2 is a schematic view of a series of products as they travel through the system and in addition showing a film folding operation.

FIG. 2 shows the various stages of wrapping of successive products P1–P5 with the plastic film 26 as the products proceed through the system 10. Product P5 is shown in FIG. 2 as being partially covered by the folded film 26 as it passes between the inverter rods 36*a*, 36*b*. Product P4 is shown exiting the side sealer 18 with the salvage 32 of the film 26 being separated from the side sealed package P4 and being collected by salvage accumulator 38. The side sealer 18 produces the side seal 34 that completes the tube envelope of relatively loose plastic film 26 around the products P.

The end sealing mechanism 20 produces a trim seal between the packages P3 and P2. The end sealing mechanism 20 also severs the film 26 to provide product P3 with a leading edge 42 and product P4 with a trailing edge 40. The product P1 is shown as it exits from the heat shrink tunnel 24 where the loose fitting film envelope is shrunk to form a tight fitting film cover. The system 10 is designed to accommodate a variety of product heights and configurations as shown by product P3 having a greater height than the other products. It will be appreciated that FIG. 2 is schematic and the relative positions of the products P1–P5 and associated components of the system 10 have been adjusted for simplification.

The component parts and the assembly in combination of the continuous high-speed wrapping system 10 of FIG. 1 will now be discussed in detail, focusing in particular on the wrapping station 16 and the film delivery unit 14.

Preferably, the product P is centered with respect to the feed conveyor 12 by means of guides (not shown) as is readily understood by those skilled in this art. The film 26 is folded about a longitudinal fold 44 thereby forming upper and lower plies 46*a*, 46*b* in which each ply has a free edge 30 opposite from the fold line 44. Commonly, the two-ply folded film 26 is provided on the supply roll 28. Alternatively, single ply film may be provided on a supply roll and subsequently folded into the described two-ply configuration as is well known in the art.

Figure 4:
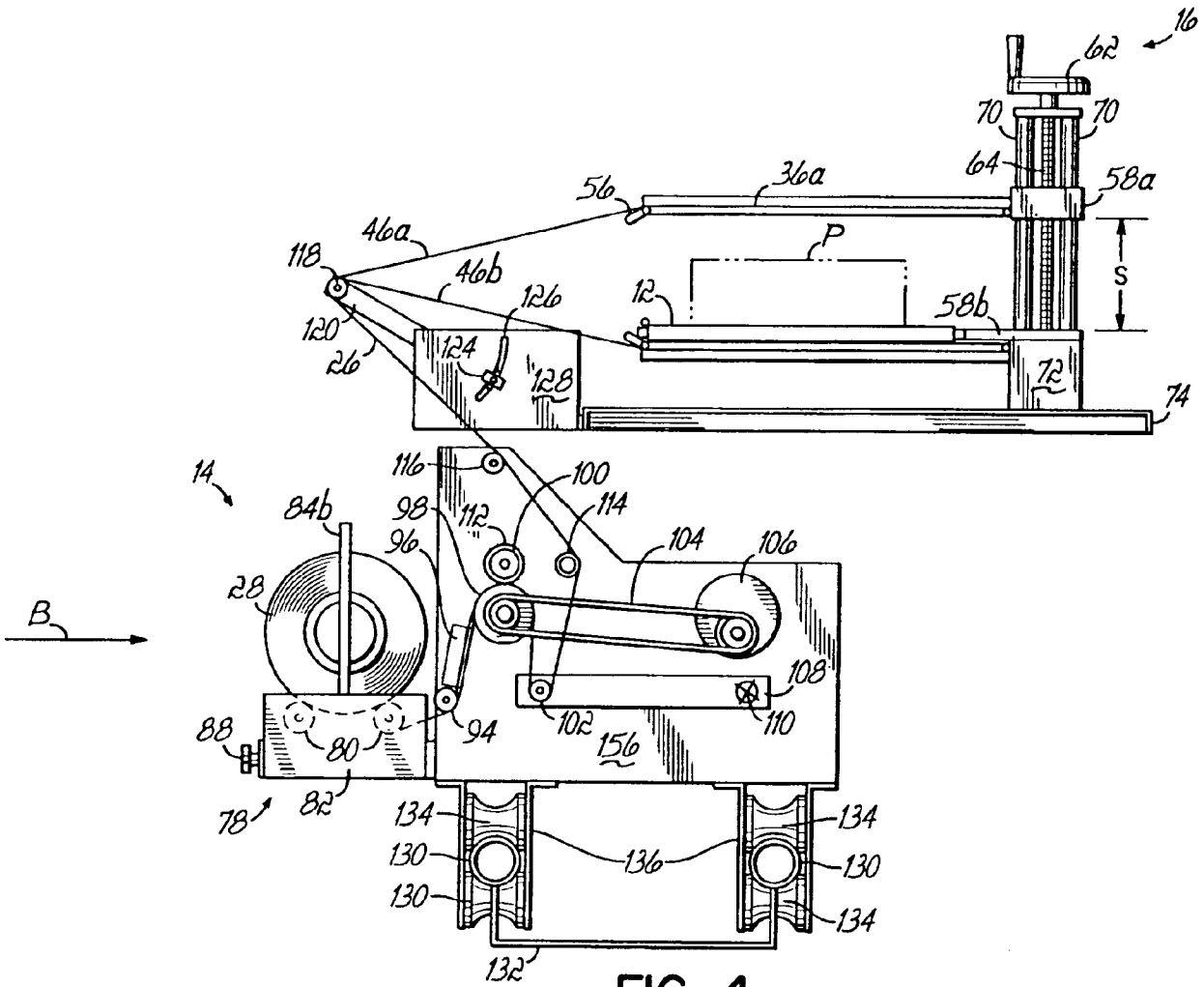
FIG. 4 is schematic end view of the components of FIG. 3 with a portion of the film delivery unit removed to show the film path.

As shown particularly in FIGS. 1, 2 and 4, the two-ply film 26 is delivered from the supply roll 28 by the film delivery unit 14 in a direction indicated by arrow B generally perpendicular to the feed direction (arrow A) of the products P. As the film 26 enters the wrapping station 16, each ply 46*a*, 46*b* is guided around one of the film inverter rods 36*a*, 36*b* and thereby redirected approximately 90° to travel in the feed direction of arrow A. The film inverter rods 36*a*, 36*b* are oriented approximately 45° with respect to the feed direction. In addition to being redirected, the film 26 is inverted by the film inverter rods such that confronting inner first faces 48, 48 of the film 26 provided by the film delivery unit 14 are inverted so that previously outer second faces 50, 50 of the plies 46*a*, 46*b* of the film 26 are juxtaposed to each other and around the product P downstream from the film inverter rods 36*a*, 36*b*.

Figure 3:
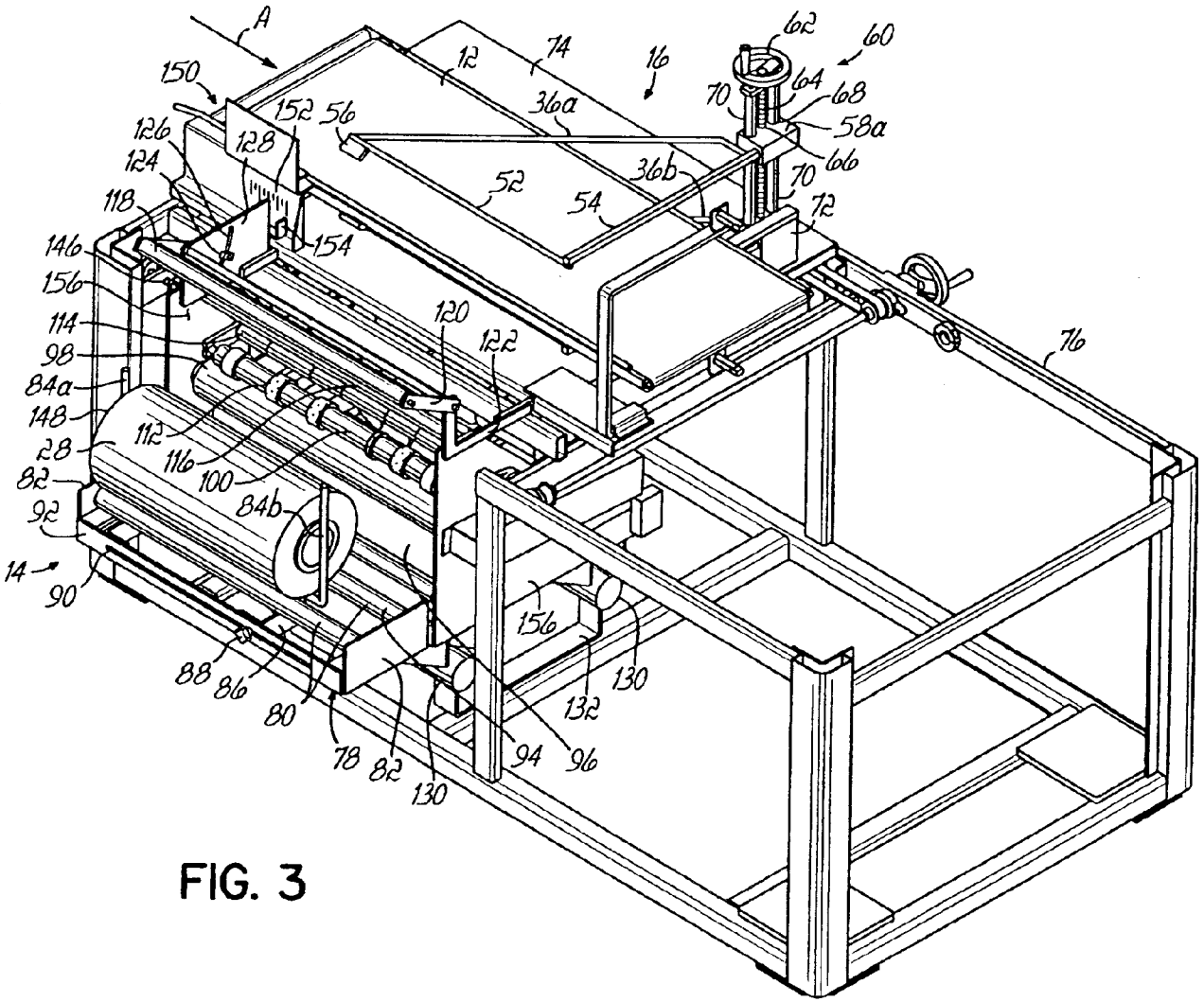
FIG. 3 is a perspective view of the film delivery unit and a product wrapping station of the system of FIG. 1.

As shown particularly in FIGS. 3 and 4, each film inverter rod 36*a*, 36*b* is joined to a pair of mounting rods 52, 54 to form a generally triangular configuration. Mounting rod 52 is oriented generally parallel to the feed direction; whereas, mounting rod 54 is oriented generally perpendicular to the feed direction. An inclined guide tab 56 is mounted proximate the intersection of each film inverter rod 36 and the associated mounting rod 52. The intersection between each film inverting rod 36 and the associated mounting rod 52 provides a reference point R which will be discussed herein below.

Film inverter rods 36*a*, 36*b* and the associated mounting rods 52, 54 are mounted to a hub 58*a*, 58*b*, respectively. The hub 58*b* for the lower film inverter rod 36*b* is fixed beneath the feed conveyor 12. The hub 58*a* for the upper film inverter rod 36*a* is mounted on a film inverter rod adjustment mechanism 60 to adjust a spacing S between the upper and lower film inverter rods 36*a*, 36*b* in a direction generally perpendicular to the feed direction (i.e., vertically) to accommodate products P of differing heights. The film inverter rod adjustment mechanism 60 in one embodiment includes an operator hand wheel 62 mounted atop a threaded rod 64 to rotate the rod 64. The hub 58*a* includes a threaded aperture 66 engaged with the threaded rod 64 as well as two additional apertures 68, 68 through which guide rods 70, 70 project. In operation of the system 10, the operator rotates the hand wheel 62 in the appropriate direction to raise or lower the upper film inverter rod 36*a* so that the upper ply 46*a* of the film 26 is positioned slightly above the top upper surface of the product P being wrapped. The upper and lower film inverter rods 36*a*, 36*b*, as well as the film inverter rod adjustment mechanism 60, are mounted to a block 72 which is supported on a platform 74 underlying the lower film inverter rod 36*b* as well as the feed conveyor 12. A frame 76 supports the wrapping station 16, associated film inverter rod components as well as the film delivery unit 14 as shown in FIG. 3. The downstream conveyors 22 and associated components are not shown in FIG. 3 to provide a better view of the components in the wrapping station 16 and the film delivery unit 14.

Figure 5:
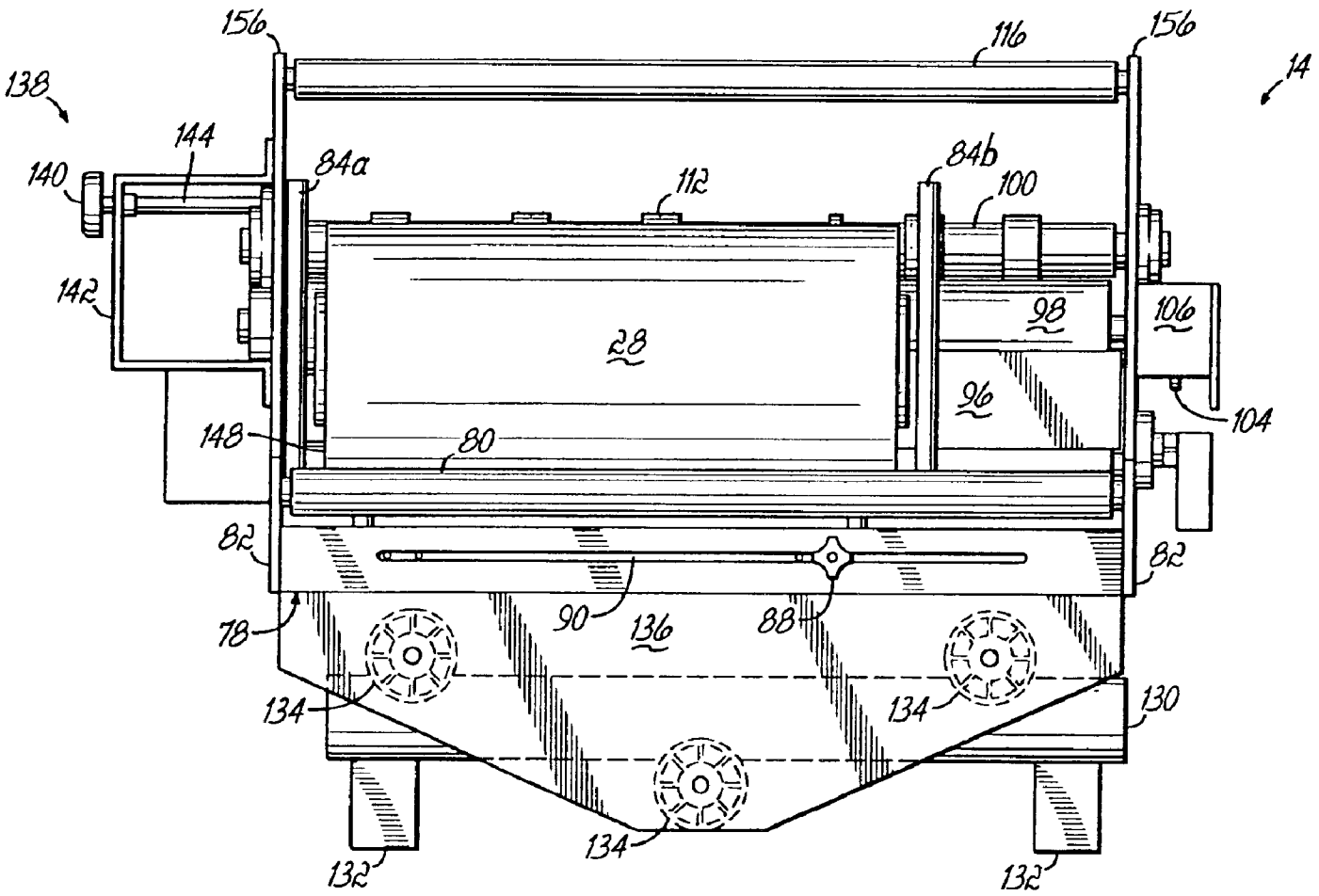
FIG. 5 is plan view of the film delivery unit of FIG. 3.

The film delivery unit 14, as shown generally in FIGS. 3–5, is mounted adjacent to the wrapping station 16 in a direction generally perpendicular to the feed direction. The film delivery unit 14 supplies film 26 from the supply roll 28 to the wrapping station 16. The supply roll 28 is supported by a cradle assembly 78 of the film delivery unit 14. The cradle assembly 78 includes a pair of spaced cradle rollers 80, 80 mounted for rotation between spaced end plates 82, 82 of the cradle assembly 78. The supply roll 28 is positioned atop the cradle rollers 80, 80 and between a pair of film roll retainer posts 84*a*, 84*b*. Preferably, the gap between the film roller retainer posts 84*a*, 84*b* is adjustable to accommodate supply rolls 28 of different lengths. Specifically, in one embodiment, the downstream film roll retainer post 84*b* is joined to a bracket 86 that is secured by a set screw 88 in a slot 90 of front frame member 92 in the cradle assembly 78. To adjust the spacing between the film roll retainer post 84*a*, 84*b* for different length supply rolls 28, the operator would loosen the set screw 88 and slide the bracket 86 and associated film roll retainer post 84*b* along the slot 90 to the appropriate position to capture the supply roll 28 between the film roll retainer post 84*a*, 84*b*.

Referring to FIG. 4, the path of the film 26 from the supply roll 28 through the delivery unit 14 and to the wrapping station 16 is shown. The supply roll 28 rotates on the cradle rollers 80, 80 and the film 26 is fed around a lower deflecting roller 94 toward a film splitter insert 96. The film splitter insert 96 advantageously separates or loosens the two film plies 46*a*, 46*b* from one another to avoid difficulty downstream in the film path in case the film 26 has an excessive build-up of static electricity, is particularly tacky or otherwise resistant to having the plies 46*a*, 46*b* separated. After the film splitter insert 96, the film 26 travels between a pair of nip rollers 98, 100 and downwardly around a dancer roller 102. The lower nip roller 98 is preferably rubber and is coupled to a belt drive 104 trained around the output shaft of a motor 106. The motor 106 rotates the rubber nip roller 98 thereby pulling the film 26 from the supply roll 28. The motor 106 which drives the roller 98 must turn the supply roll 28 in a direction to provide film 26 to the wrapping station 16. The motor 106 must at all times provide film 26 in excess of the maximum speed of the feed conveyor 12 to ensure minimum tension of the film 26 as it passes over the film inverter rods 36*a*, 36*b*. The dancer roller 102 is coupled to a tension arm 108 for pivotal movement about a tension pivot 110 to maintain tension on the film 26. If slack in the film 26 develops because of an interruption in the flow of products P, for example, the tension arm 108 is coupled to a controller (not shown) for the motor 106 to interrupt the dispensing of the film 26 until additional film is required by the wrapping station 16. As such, film tension is controlled by the dancer roller 102 through the tension arm 108 in association with the control of the motor 106.

The upper nip roller 100 may include a number of pins or spikes 112 to perforate the film 26 passing between the nip rollers 98, 100 as is customary in the shrink wrap industry. The film 26 passes around an intermediate deflecting roller 114 and an upper deflecting roller 116 before exiting the film delivery unit 14. The various rollers 94, 98, 100, 102, 114 and 116 extend between a pair of spaced sidewalls 156, 156 of the film delivery unit 14.

The system 10 includes a film delivery height adjustment roller 118 positioned between the film delivery unit 14 and the wrapping station 16. The roller 118 is mounted between a pair of arms 120, 120 which are coupled to corresponding links 122 mounted to the frame 76. Advantageously, the position of the arms 120, 120 and subsequently the position of the roller 118 is adjustable to deliver the film 26 to the wrapping station 16 at an appropriate height relative to the position of the film inverter rods 36*a*, 36*b*. Preferably, the vertical position of the roller 118 is equal distance between the upper and lower film inverter rods 36*a*, 36*b*. Since the spacing S between the film inverter rods is adjustable, the height of the film delivery roller 118 is likewise adjustable to provide for proper positioning relative to the film inverter rods 36*a*, 36*b*. The arm 120 supporting the roller 118 includes a set screw 124 which is captured within an arcuate slot 126 in a guide plate 128. Adjustment of the roller 118 height is accomplished by the operator by loosening the set screw 124 and pivoting the arms 120 coupled to the roller 118 upwardly or downwardly as desired and then resecuring the set screw 124 with the roller 118 in the appropriate position approximately midway between the upper and lower film inverter rods 36*a*, 36*b*. As the film 26 passes around the roller 118, the two plies 46*a*, 46*b* are separated and guided by the respective film inverter rods 36*a*, 36*b* to surround the product P on the conveyor 12.

As shown particularly in FIGS. 3–5, the film delivery unit 14 is movably mounted relative to the frame 76 on a pair of spaced generally tubular rails 130, 130. In one embodiment, each of the rails 130 extends generally in the feed direction and is supported on one of a pair of spaced generally U-shaped brackets 132 mounted to a lower portion of the frame 76. The film delivery unit 12 moves on the rails 130, 130 by a series of support roller bearings 134. Each support roller bearing 134 is mounted for rotation between a pair of downwardly depending support plates 136, 136 mounted on a lower surface of the film delivery unit 14. Preferably, each pair of support plates 136, 136 has two upper and one lower support roller bearing 134 mounted therebetween for rotation along the respective rail 130. The support roller bearings 134 are positioned as generally shown in FIG. 5 to provide support and stable movement along the rails 130, 130 of the film delivery unit 14 as required.

The position of the film delivery unit 14 is adjustable on the rails 130, 130 in a direction generally parallel to the feed direction in via a film delivery unit adjustment mechanism 138. The film delivery unit adjustment mechanism 138 according to one embodiment of this invention provides for proper positioning and delivery of the film 26 to the wrapping station 16 as a function of the spacing S between the film inverter rods 36*a*, 36*b*. Specifically, in one embodiment, the film delivery unit adjustment mechanism 138 includes an adjustment knob 140 mounted for rotation and projecting from casing 142 mounted to the frame 76. The adjustment knob 140 is mounted for rotation relative to the casing 142 and is coupled to a threaded rod 144 which is engaged in a threaded aperture 146 in one of the sidewalls 156 of the film delivery unit 14. As such, rotation of the adjustment knob 140 and the threaded rod 144 attached thereto moves the film delivery unit 14 in a lateral direction, as shown in FIG. 5, or upstream/downstream relative to the feed direction. Proper positioning of the film delivery unit 14 and the supply roll 28 according to this invention provides for accurate and precise film 26 geometry as it is delivered through the film delivery unit 14 to the wrapping station 16. Preferably, the film inverter rods 36*a*, 36*b* in the wrapping station 16 remain stationary as the position of the film delivery unit 14 is adjusted.

In particular, it has been determined that the relative position of the film inverter rods 36*a*, 36*b* in the feed direction compared to the leading or upstream edge 148 of the film supply roll 28 mounted on the delivery unit 14 is important to maintain proper geometry of the film 26 being dispensed from the supply roll 28 through the delivery unit 14 and applied at the wrapping station 16 to the products P on the conveyor 12. The relative position of the upstream edge 148 of the supply roll 28 in comparison to the reference point R on the film inverter rods 36*a*, 36*b* is utilized to provide for proper film delivery geometry.

As the spacing S between the upper and lower film inverter rods 36*a*, 36*b* is adjusted to accommodate different height products P, movement of the film delivery unit 14 in a direction generally parallel to the feed direction is required to maintain proper film delivery geometry. For products P which are extremely thin and having little or no height such as a CD lying generally flat on the feed conveyor 12, the reference point R on the film inverter rods 36*a*, 36*b* is generally aligned with the upstream edge 148 of the supply roll 28 on the film delivery unit 14. However, the film delivery unit 14 must be moved in a direction generally parallel to the feed direction as the spacing S between the film inverter rods 36*a*, 36*b* is adjusted to accommodate different height products P.

In operation, the spacing S between the film inverter rods 36*a*, 36*b* is adjusted to accommodate the product P height. Once the film inverter rods 36*a*, 36*b* are so adjusted, the position of the film delivery height adjustment roller 118 is likewise set by the operator to be approximately equal distance between the film inverter rods 36*a*, 36*b*. The film delivery unit 14 is then moved relative to the reference point R on the film inverter rods 36*a*, 36*b* to provide for proper alignment, geometry and delivery of the film 26 to the wrapping station 16. According to one embodiment of this invention, the film delivery unit 14 is moved via the adjustment knob 140 along the rails 130 one-half inch to adjust for each inch in package height to establish the correct film delivery geometry. The film inverter rods 36*a*, 36*b* at the wrapping station 16 should remain stationary as the film delivery unit 14 position is adjusted. For each inch increase in product height, the position of the film delivery unit 14 is adjusted one-half inch in the upstream direction. Conversely, for each inch decrease in package height or spacing between the film inverter rods 36*a*, 36*b*, a half-inch movement of the film delivery unit 14 in the downstream feed direction is required for correct film geometry.

Figure 1A:
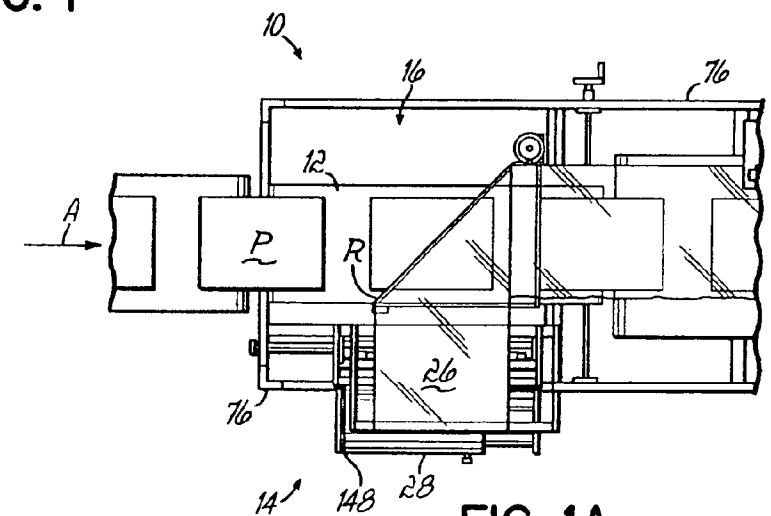
FIG. 1A is a view similar to FIG. 1 of a portion of the wrapping system with a film delivery unit re-positioned.

For example, as shown in FIG. 1, the relative position of the edge 148 of the supply rod 28 compared to the reference point R provides appropriate tracking and film 26 delivery geometry for a product such as P3 of FIG. 2. However, for a product P4 of lesser height, the spacing S is decreased and the edge 148 is adjusted with the film delivery unit 14 downstream parallel to the feed direction to a position relative to reference point R as shown in FIG. 1A.

A product height indicator 150 is provided to indicate the spacing S between the film inverter rods 36*a*, 36*b*. A product height adjustment scale 152 is mounted on the frame 76 and an indicator 154 moves with the film delivery unit 14 so that the operator may accurately position the film delivery unit 14 relative to the inverter rods 36*a*, 36*b*. While the adjustment mechanisms 60 and 138, as well as the positioning of roller 118, are shown and described herein as being independent from each other, alternative embodiments of this invention include automatic adjustment of the positions of the film roll 28 and/or roller 118 in response to changes to the spacing S.

An important feature of this invention is the positioning of the film delivery unit 14 and the supply roll 28 thereon relative to the film inverter rods 36*a*, 36*b* in the feed direction. According to one embodiment of this invention, the film delivery unit adjustment mechanism 138 adjusts the position of the film delivery unit 14 in the upstream or downstream directions. Alternatively, the position of the film inverter rods 36*a*, 36*b* relative to the feed direction may be adjusted by movement of the block 72 relative to the frame 76 and supply roll 28 to provide for the appropriate relative position between the film inverter rods 36*a*, 36*b* and the supply roll 28 mounted on the film delivery unit 14. Nevertheless, as a result of this invention, proper film delivery geometry from the supply roll to the film inverter rods can be easily and efficiently obtained in conjunction with the adjusted spacing between the film inverter rods to accommodate varying height products without fouling the delivery of the film along the film path and maintaining alignment of the free edges of the plies of the film wrapped around the products.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. A method for wrapping a series of products of differing heights in film, the method comprising the steps of:

serially feeding a first and a second product in a feed direction to a wrapping station, a height of the first product being different than a height of the second product;

delivering film to the wrapping station from a supply of film, the film having first and second plies joined together along a longitudinal fold line, each of the first and second plies having a free edge spaced from and generally parallel to the longitudinal fold line and a first face opposite from a second face, the respective first faces of the plies being juxtaposed to one another prior to arrival at the wrapping station;

inverting the film with a first and a second film inverter rod at the wrapping station, the film inverter rods being spaced from one another;

wherein the film inverter rods cooperate to invert the first and second plies so that the respective second faces of the plies are juxtaposed to one another after the film is inverted;

wrapping the first product with the film at the wrapping station;

adjusting the spacing between the film inverter rods after the first product exits the wrapping station, the spacing being adjusted to correspond to the height of the second product;

adjusting a position of the supply of film relative to the film inverter rods in a direction generally parallel to the feed direction to provide for proper delivery of the film to the wrapping station as a function of the spacing between the film inverter rods; and wrapping the second product with the film at the wrapping station.

2. The method of claim 1 wherein the delivering of the film to the wrapping station is in a direction generally perpendicular to the feed direction, the method further comprising:

redirecting the film being delivered to the wrapping station to a direction generally parallel to the feed direction.

3. The method of claim 2 wherein the redirecting and the inverting of the film are both accomplished with the film inverter rods.

4. The method of claim 1 further comprising:

adjusting a height at which the film is delivered to the wrapping station.

5. The method of claim 4 wherein the film is delivered to the wrapping station at about mid-height of the product to be wrapped.

6. The method of claim 1 wherein the position of the supply of film is adjusted upstream and downstream relative to the film inverter rods if the second product is greater and lesser, respectively, in height relative to the first product.

7. The method of claim 1 wherein an amount that the position of the supply of film is adjusted is about half of an amount that the spacing between the film inverter rods is adjusted between the wrapping of the first and second products.

8. The method of claim 1 further comprising:

sealing the first and second plies together proximate the respective free edges of the plies.

9. The method of claim 8 further comprising:

sealing the first and second plies together in a direction transverse to the feed direction.

10. The method of claim 9 further comprising:

shrinking the film around the first and second products, respectively.

11. A method for wrapping a series of products of differing heights in film, the method comprising the steps of:

serially feeding a first and a second product in a feed direction to a wrapping station, a height of the first product being different than a height of the second product;

delivering film to the wrapping station from a supply of film in a direction generally perpendicular to the feed direction, the film having first and second plies joined together along a longitudinal fold line, each of the first and second plies having a free edge spaced from and generally parallel to the longitudinal fold line and a first face opposite from a second face, the respective first faces of the plies being juxtaposed to one another prior to arrival at the wrapping station;

inverting the film with a first and a second film inverter rod at the wrapping station, the film inverter rods being spaced from one another;

wherein the film inverter rods cooperate to invert the first and second plies so that the respective second faces of the plies are juxtaposed to one another after the film is inverted;

redirecting the film being delivered to the wrapping station to a direction generally parallel to the feed direction;

wrapping the first product with the film at the wrapping station;

sealing the first and second plies together proximate the respective free edges of the plies;

sealing the first and second plies together in a direction transverse to the feed direction;

adjusting the spacing between the film inverter rods after the first product exits the wrapping station, the spacing being adjusted to correspond to the height of the second product;

adjusting a position of the supply of film relative to the film inverter rods in a direction generally parallel to the feed direction to provide for proper delivery of the film to the wrapping station as a function of the spacing between the film inverter rods;

wrapping the second product with the film at the wrapping station; and shrinking the film around the first and second products, respectively.

12. The method of claim 11 wherein the redirecting and the inverting of the film are both accomplished with the film inverter rods.

13. The method of claim 11 further comprising: adjusting a height at which the film is delivered to the wrapping station.

14. The method of claim 13 wherein the film is delivered to the wrapping station at about mid-height of the product to be wrapped.

15. A method of delivering film having first and second plies having free edges and being joined together along a longitudinal fold line to define confronting faces of the plies over a product to be wrapped comprising:

passing a length of the film from a supply thereof in a first direction over a pair of spaced-apart film inverter rods situated so as to invert the film plies and cause both the first and second plies of the film to proceed in a second direction generally perpendicular to the first direction so as to envelop a product;

selectively varying the spacing between the film inverter rods in a third direction generally perpendicular to both the first and second directions; and selectively adjusting the relative position of the supply and the film inverter rods as a function of the spacing between the film inverter rods so as to align the free edges of the plies as they pass off of the inverter rods.

16. The method of claim 15 further comprising:

mounting a roll of the film on a cradle; and adjusting the position of the cradle orthogonally relative to the first direction to thereby selectively adjust the relative position of the supply and the film inverter rods.

17. The method of claim 15 further comprising:

passing the film in the first direction over a roller; and adjusting the height of the roller to thereby selectively adjust the relative position of the supply and the film inverter rods.

18. The method of claim 17 wherein the film is delivered to the wrapping station at about mid-height of the product to be wrapped.

19. The method of claim 15 further comprising:

enveloping a subsequent product with the film wherein a height of the subsequent product is different from a height of the product.

20. The method of claim 15 wherein respective axes of the first and second film inverter rods are generally parallel with each other.

* * * * *